United States Patent [19]

Kiss et al.

[11] 4,243,121

[45] Jan. 6, 1981

[54] WEB LADDER RELEASE MECHANISM

[76] Inventors: Alexander S. Kiss, P.O. Box 209, Queenston, Niagara-on-the-Lake, Ontario, Canada; Frank B. Leslie, 8883 Niagara River Pkwy., Niagara Falls, Ontario, Canada, L2E 6S6

[21] Appl. No.: 85,000

[22] Filed: Oct. 15, 1979

[30] Foreign Application Priority Data

Sep. 11, 1979 [CA] Canada ..... 335418

[51] Int. Cl.[3] ..... E06C 1/56

[52] U.S. Cl. ..... 182/196; 182/206

[58] Field of Search ..... 182/196, 197, 198, 199, 182/206

[56] References Cited

U.S. PATENT DOCUMENTS

| | | | |
|---|---|---|---|
| 3,307,654 | 3/1967 | Green | 182/206 |
| 3,385,399 | 5/1968 | Burt | 182/206 |
| 3,907,064 | 9/1975 | Svalberg | 182/206 |
| 4,089,390 | 5/1978 | McLain | 182/206 |

*Primary Examiner*—Reinaldo P. Machado
*Attorney, Agent, or Firm*—Sim & McBurney

[57] ABSTRACT

There is provided the combination of a frame and a collapsible ladder. The frame defines two spaced-apart horizontal passages in which catch elements are mounted. Resilient means urge the catch elements toward each other, and manual thumbscrew means are provided to pull the catch elements away from each other. A collapsible ladder has attachment means at the top by which it can be anchored, and the ladder also includes a containment means constituted by the bottom rung and two upstanding side members which register with all of the remaining rungs. The upstanding side members have openings at the top into which the catch members extend when in their innermost positions. Manual release is possible by which the side members become disengaged from the frame, thus allowing the web ladder to fall into a position of use.

7 Claims, 6 Drawing Figures

WEB LADDER RELEASE MECHANISM

This invention relates generally to collapsible safety ladders for use in escaping from buildings, for example during fires or other danger.

Many forms of such collapsible safety ladders are already known, and the following patents are exemplary in this respect:

U.S. Pat. No. 3,307,654 Green et al, Mar. 7, 1967

U.S. Pat. No. 3,415,341 E. R. Hostetler, Dec. 10, 1968

U.S. Pat. No. 2,735,603 C. H. Corey, Feb. 21, 1956

U.S. Pat. No. 3,078,954 K. C. MacLeod, Feb. 26, 1963

U.S. Pat. No. 2,985,254 E. A. Marryatt, May 13, 1961

U.S. Pat. No. 1,349,125 P. Full, Aug. 10, 1920.

The prior art represented by the above-mentioned patents includes several frame structures adapted to retain a ladder in collapsed form when not being used, and adapted to release the ladder to fold downwardly when required. The Green et al U.S. Pat. No. 3,307,654 is a representative patent in this regard.

It is an aspect of this invention to provide a collapsible ladder retention and release mechanism which is relatively fail-safe in action, very simple to release, and strong enough for the purposes required.

Accordingly, this invention provides, in combination:

frame means adapted for attachment adjacent an opening in a building, the frame means defining two spaced-apart, substantially horizontal passages, a catch element mounted for reciprocation within each passage, resilient means urging each catch element in one direction with respect to its passage, manual means for urging each catch element against its respective resilient means, and a collapsible ladder having attachment means by which a top end of the ladder may be anchored, the ladder also having containment means with reception means for receiving said catch elements when the latter are shifted in said one direction, whereby the containment means are retained with respect to the frame means, the containment means when so retained being adapted to maintain the ladder in collapsed condition.

One embodiment of this invention is illustrated in the accompanying drawings, in which like numerals denote like parts throughout the several views, and in which.

Figure 1:
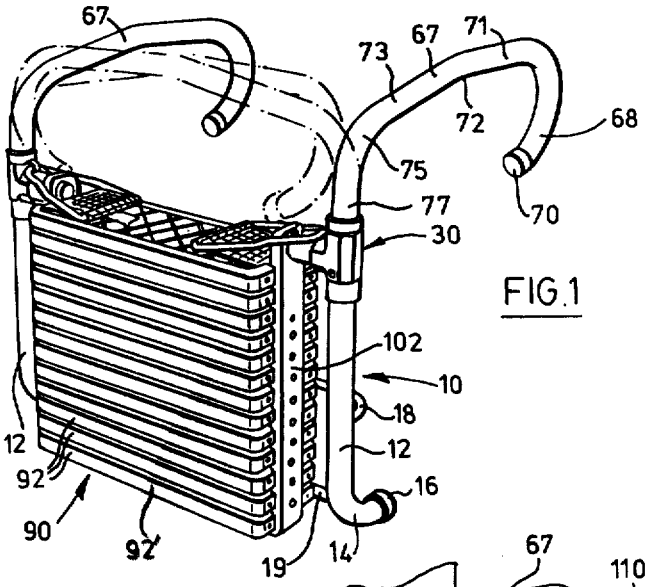
FIG. 1 is a perspective view of a combination of a frame and a collapsed ladder, constructed in accordance with this invention.

Turning first to FIG. 1, there is shown a frame 10 which includes two vertical, spaced-apart hollow metallic members 12, each having a J-curve 14 at the bottom, terminating in a protective cap 16. The two vertical members 12 are maintained apart in fixed positions with respect to each other by bracing structure constituted by a first horizontal member 18 and a second horizontal member 19. These members are more fully visible in FIG. 2, and the mode of attachment of the horizontal members 18 and 19 to each of the vertical members 12 can be seen in FIG. 3. As pictured in FIG. 3, the second horizontal member 19 is rectilinear, and each end passes into a bore 21 on the inside of the respective vertical member 12, adjacent the protective cap 16, so that the end of the horizontal member 19 abuts the inner face of the outside wall of the vertical member from the inside. A smaller opening is provided at this location opposite from the aperture 21, and a machine screw 22 is threaded into a suitable tapped bore in the end of the horizontal member 19, thereby drawing the end of the horizontal member from the inside up against the outside wall of the vertical member 12.

Figure 3:
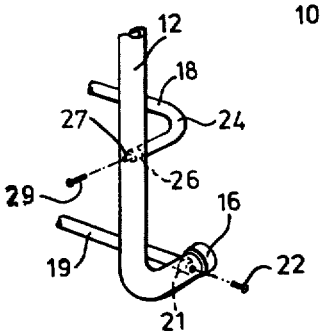
FIG. 3 is a partial detail, in perspective, showing the construction of a part of the frame.

The first horizontal member 18 is curved as shown at 24 in FIG. 3, and its end likewise passes into an aperture 26 in the rear wall of the vertical member 12, such that the actual end part of the horizontal member 18 can abut against the forward wall of the vertical member 12 from the inside. An opening 27 is again provided for a machine screw 29 to be threaded into a tapped bore in the end of the horizontal member 18.

The connections to the opposite vertical member 12 are identical to those shown in FIG. 3.

Figure 4:
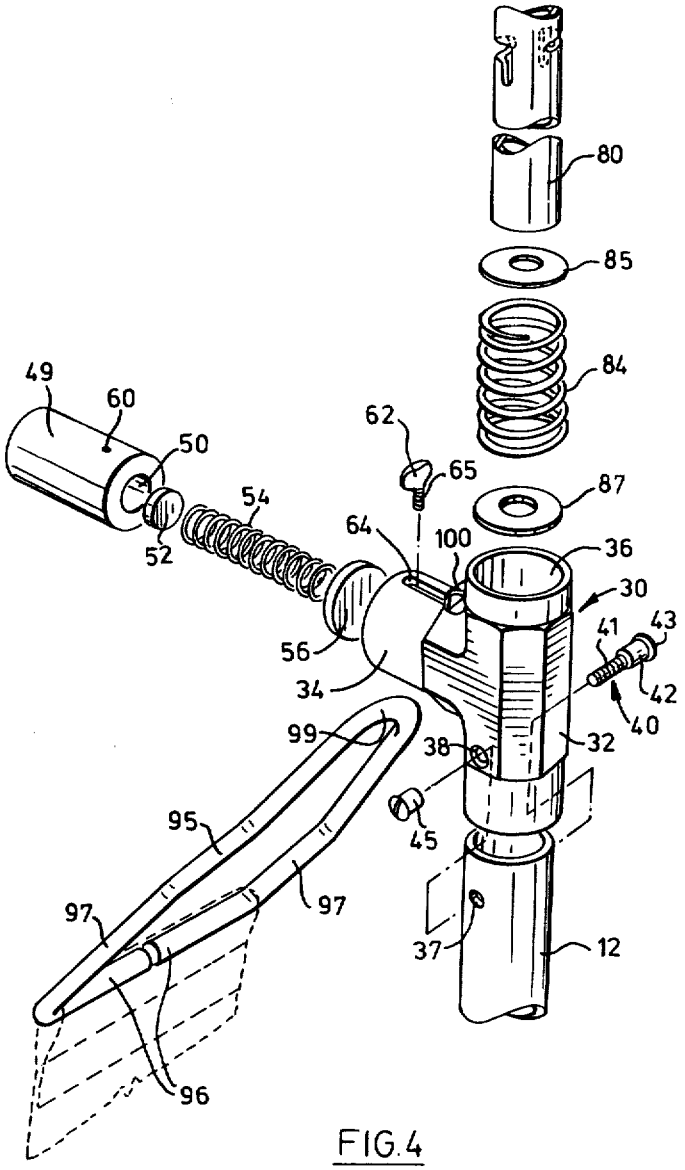
FIG. 4 is an exploded perspective view showing the construction of another part of the frame.

Each of the vertical members 12 is connected at its upper end to a T-structure 30 which is seen in greater detail in FIG. 4. The T-structure 30 has a vertical portion 32 and a horizontal arm 34 integrally abutting the vertical portion 32 intermediate the ends of the latter. The vertical portion 32 defines inwardly a circular bore 36 the bottom end of which is adapted snugly but slidably to receive the upper end of a vertical member 12. The upper end of each vertical member 12 is provided with two diametrically opposite holes 37 (only one visible in FIG. 4) capable of being aligned with two diametrically opposite openings 38 through the lower part of the vertical portion 32 of the T-structure 30.

A metal screw 40 having a threaded shank 41, an unthreaded collar 42 and a head 43 is adapted to cooperate with a slotted nut member 45 into which the shank 41 can be screwed. The slotted nut member 45 also has a collar similar to the collar 42, and the two collars are adapted snugly but slidably to enter the openings 38 and to register in the openings 37. The shank 41 is smaller in diameter than the collar 42 and the function of this shank 41 will be explained subsequently. It will thus be understood that when the machine screw 40 is in place, and the slotted nut member 45 has been screwed tightly onto its end, with the vertical member 12 in place within the bottom end of the vertical portion 32 of T-structure 30, the vertical member 12 and the T-structure 30 are securely attached together.

Figure 5:
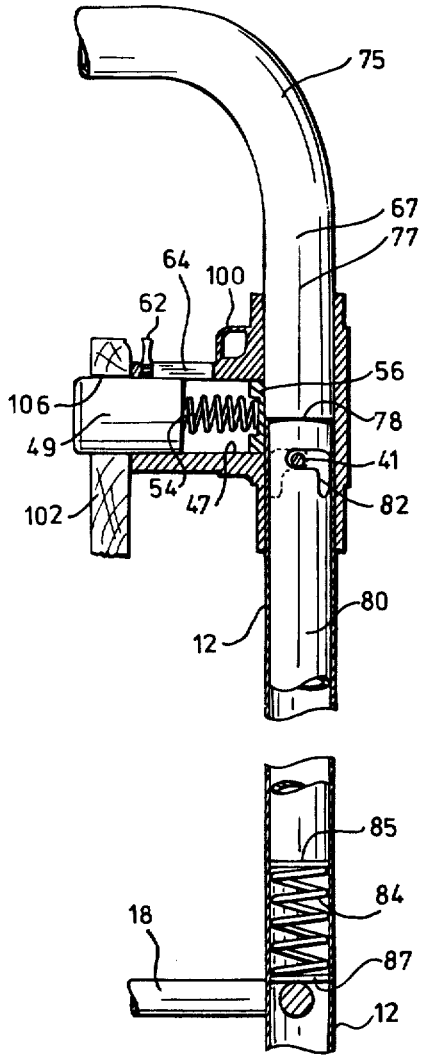
FIGS. 5 and 6 are vertical sectional views through a portion of the frame illustrating the release function thereof.

The arm 34 of each T-structure 30 defines a horizontal passage 47 which is circular and communicates with bore 36. Attention is directed to FIG. 5, in which it can be seen that a catch element 49, which is cylindrical in shape, is mounted for reciprocation within each passage 47. Each catch element 49 is snugly but slidably received within its respective passage 47. As seen in FIG. 4, the catch element 49 has a central blind bore 50 into which a spring pad 52 can be inserted to the end, against which a compression coil spring 54 can rest. The pad 52 may be of wood or other nonmetallic material. The other end of the compression coil spring 54 rests against the centre of a larger pad 56 received within the passage 47. The pad 56 rests against the outer wall of a hook arm 67 later to be described. The pad 56 preferably has a central circular recess in which the rightward end of the compression coil spring 54 may be received.

The catch element 49 has a tapped bore 60 in its upper surface, into which a thumbscrew 62 may be threaded. The arm 34 has an axial slot 64 through which the shank 65 of the thumbscrew 62 may pass without binding, such that the thumbscrew 62 may be screwed into the tapped bore 60 in the catch element 49 when the latter has been inserted into the passage 47 with the tapped bore 60 in alignment with the slot 64. The assembled relationship is shown in FIGS. 5 and 6.

Figure 2:
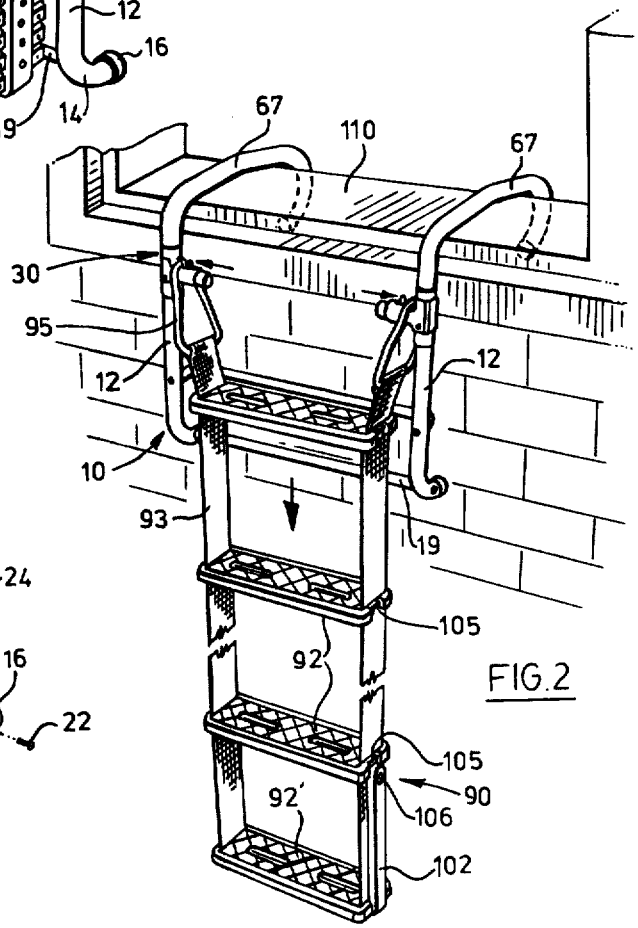
FIG. 2 shows the combination of FIG. 1 in use, with the ladder extended.

The frame 10 further includes two hook arms 67 shaped as shown in FIGS. 1 and 2. More specifically, each hook arm 67 has a free end 68 terminating in a protective cap 70, from which free end the hook arm 67 curves upwardly and then horizontally along a first rectilinear portion 71, through an obtuse-angled bend 72, along a second rectilinear portion 73, through a curved portion 75, and finally terminating in a rectilinear vertical portion beginning where shown at 77, but extending well down into the interior of the vertical member 12. Thus, in FIGS. 1 and 2, the lower portion of each hook arm 67 is not visible. With reference to FIG. 5, it can be seen that each hook arm 67 undergoes a reduction in outside diameter at the location 78, the reduced diameter portion 80 continuing downwardly, and being of such a diameter as to allow it to fit snugly but slidably and rotatably within the interior of the hollow vertical member 12. Furthermore, the portion 80 of each hook arm 67 has, below but closely adjacent the line 78 marking the reduction in diameter, two oppositely disposed L-shaped slots 82, the width of which is sufficient to allow passage of the collar 42 and nut member 45, respectively. The shank 41 of the machine screw 40 is shown hatched in FIGS. 5 and 6. One of the L-shaped slots 82 is visible in solid lines in FIG. 5, while the other is shown in broken lines, as it is located on the opposite wall of the portion 80.

Figure 6:
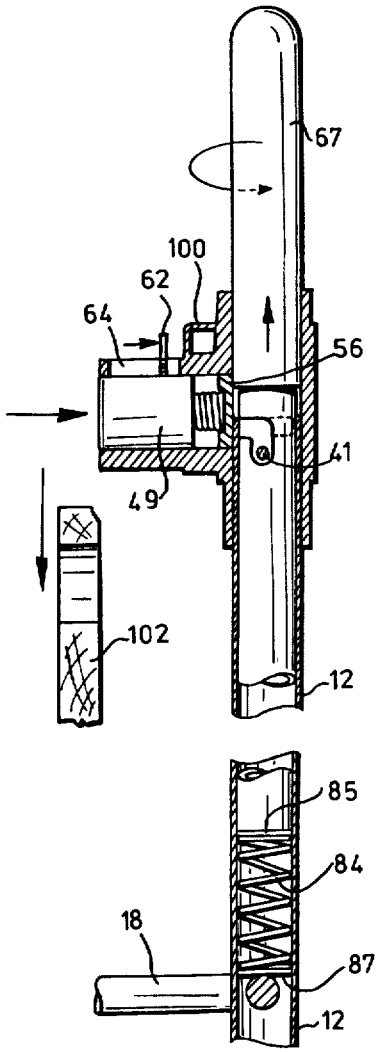

The position of the L-shaped slot 82 is such that, when the screw 40 is located in the vertical portion of the L-shaped slot 82, as seen in FIG. 6, the curved part of the hook arm 67 lies in a vertical plane perpendicular to the vertical plane containing both of the vertical members 12. If, beginning with the configuration of FIG. 6, the hook arm 67 is lowered, and then rotated in the counter-clockwise sense as seen from above with the screw 40 registering in the horizontal portion of the L-shaped slot 82, the arm 67 can be rotated through approximately 90° to a position in which it lies substantially in the vertical plane passing through both of the vertical members 12. This configuration is shown in FIG. 5. Naturally, due to mechanical interference, it is not possible to have both of the hook arms 67 lying precisely in the vertical plane containing the members 12. Instead, the hook arms 67 will assume an overlapped relation as shown in broken lines in FIG. 1.

As seen at the lower end of FIGS. 5 and 6, a compression coil spring 84 has its upper end urging upwardly against a washer 85 fitting snugly but slidably within the center bore of the vertical member 12, and bearing against the bottom end of the portion 80 of the hook arm 67. The lower end of the compression coil spring 84 bears against another washer 87, which in turn rests upon the end part of the first horizontal member 18, at the location where the latter enters and passes through the vertical member 12.

Thus, at all times each hook arm 67 is being urged toward its uppermost position. The only way it can assume an upper position is in the configuration of FIG. 6, and when the hook arm 67 is disposed as shown in FIG. 6, it cannot be rotated, due to the fact that the screw 40 is lodged in the vertical portion of the slot 82. Conversely, when a hook arm 67 is in the position of FIG. 5, the spring 84 is compressed, and the hook arm 67 is in its lowermost position. In the FIG. 5 condition, the hook arm can be rotated.

To change the hook arm 67 from the stabilized or "locked" position of FIG. 6 to the folded position of FIG. 5, the hook arm 67 is first depressed into the vertical member 12, to compress the coil spring 84 and to cause the screw 40 to be located at the upper end of the vertical portion of the slot 82. When this situation is attained, the hook arm 67 can be rotated toward the other hook arm, and toward the positions shown in broken lines in FIG. 1.

Also forming part of the combination of this invention is a collapsible ladder shown generally at the numeral 90 in FIG. 1, the ladder being in its collapsed position in FIG. 1, and its extended position in FIG. 2. The ladder 90 is a web ladder which utilizes wide, step-like rungs 92 and flexible side retainers 93 made of web material. The actual construction of the collapsible ladder 90 is disclosed in copending Canadian Patent Application No. 298,018, entitled WEB LADDER and filed Mar. 1, 1978. As far as the present invention is concerned, the essential features of the collapsible ladder 90 include attachment means at the top end of the ladder by which the ladder may be anchored. In FIG. 2, the attachment means secures the top end of the ladder to the frame 10, and includes metallic hooks 95, having two aligned end portions 96, riser portions 97, and a looped portion 99. Each arm 34 of a T-structure 30 defines a loop 100 through which the looped portion 99 of the metallic hook 95 passes.

As can be seen in FIG. 4, the vertical section through the arm 34 of the T-structure 30 adjacent the loop 100 is substantially circular. In order to avoid binding of the metallic hook 95 in the loop 100, the looped portion 99 of the metallic hook 95, which passes around the arm and through the loop 100, has a radius slightly larger than that of the arm 34.

The collapsible ladder 90 includes containment means having reception means for receiving the catch elements 49 when the latter are shifted toward each other by the coil springs 54. The containment means, in the embodiment shown, is constituted by a bottom rung 92' (FIGS. 1 and 2), and two upstanding side members 102 which are fixed rigidly with respect to the bottom rung at the two ends thereof. Only one of the side members 102 is visible in each of the figures, the other being hidden by the remainder of the structure. Each of the other rungs 92 has indentations at either end which register with the side members 102. The indentations are shown at the numeral 105 in FIG. 2, and the actual registration can be seen clearly at the right in FIG. 1. Because of this registry, the various rungs 92 can be "stacked" one on top of the other between the side members 102, with the intervening portions of the web 93 being folded inwardly in a loop between each adjacent pair of rungs 92. Each side member 102 has, at its top, an opening 106 for registering with and receiving one of the catch elements 49.

In FIG. 5, a side member 102 is shown in registry with a catch element 49 extending through it, and it can be seen that the compression coil spring 54 has driven the catch element 49 to its furthest leftward position, in which the thumbscrew 62 abuts the leftward end of the slot 64.

It is to be understood that, in assembled and retained condition (i.e. prior to release for use as a fire escape), both of the members 102 will be in register with their respective catch elements 49, and this retains the ladder 90 in its collapsed condition with respect to the frame 10 (see FIG. 1).

To release the ladder for use as a fire escape, the user simply places his two thumbs on the inside of the respective thumbscrews 62, and presses outwardly or to the side. This will move the respective catch elements 49 away from each other against the pressure of the respective compression coil springs 54, thus removing the catch element 49 from engagement with the respective opening 106, thereby releasing the side members 102 to fall downwardly, and in effect releasing the entire ladder except for the connection by way of the metallic hooks 95.

As can be seen in FIG. 2, the hook members 67 are adapted to be engaged with the window sill 110.

Naturally, the apparatus just disclosed may be left in position on a window sill until it is needed as a fire escape, although this may interfere with the closing and opening of the window. Preferably, the entire apparatus is made as small as possible by closing the hook arms 67 toward each other into the position shown in broken lines in FIG. 1, and then the entire unit can be stored under a bed, in a closet or in some other out-of-the-way location.

We claim:

1. In combination:

frame means adapted for attachment adjacent an opening in a building, the frame means defining two spaced-apart, substantially horizontal passages, a catch element mounted for reciprocation within each passage, resilient means urging each catch element in one direction with respect to its passage, manual means for urging each catch element against its respective resilient means, and a collapsible ladder having attachment means by which a top end of the ladder may be anchored, the ladder also having containment means with reception means for receiving said catch elements when the latter are shifted in said one direction, whereby the containment means are retained with respect to the frame means, the containment means when so retained being adapted to maintain the ladder in collapsed condition.

2. The combination claimed in claim 1, in which the collapsible ladder has a plurality of rungs of which the bottom one has two upstanding side members fixed rigidly thereto at the two ends thereof, the bottom rung and the side member constituting said containment means, the other rungs having indentations at either end for registry with said side members, each side member having an opening at its top for receiving one of the catch elements.

3. The combination claimed in claim 2, in which the said horizontal passages are coaxial and cylindrical, in which the resilient means is constituted by a compression spring for each catch element, and in which the manual means is constituted by a projection extending from each catch element out through an axial slot in the side of the respective horizontal passage.

4. The combination claimed in claim 2, in which the frame means has two vertical, spaced-apart members each supporting at its upper end a T-structure defining one of said passages, two hook arms extending upwardly from said T-structures and swingable about vertical axes with respect thereto, and bracing structure between the vertical members to maintain them in fixed positions with respect to each other.

5. The combination claimed in claim 2, claim 3 or claim 4, in which said attachment means secures the top end of the ladder to said frame means.

6. The combination claimed in claim 4, in which the collapsible ladder includes webs extending between said plurality of rungs, the top of each web extending beyond an uppermost rung and being secured to a metallic hook, each metallic hook passing through a loop defined adjacent an arm of one of the T-structures.

7. The combination claimed in claim 6, in which the vertical section of said arm of the T-structure is substantially circular, and in which said metallic hook has a circularly curved portion passing around said arm and through said loop, the said portion having a radius slightly larger than said arm, whereby to avoid binding in said loop.

* * * * *